252-104 AU 157 EX
4/28/87 XR 4,661,280

United States Patent [19]
Ouhadi et al.

[11] Patent Number: 4,661,280
[45] Date of Patent: Apr. 28, 1987

[54] BUILT LIQUID LAUNDRY DETERGENT COMPOSITION CONTAINING SALT OF HIGHER FATTY ACID STABILIZER AND METHOD OF USE

[75] Inventors: Trazollah Ouhadi, Liege; Guy Broze, Grace-Hollogen; Louis Dehan, Neupre; Daniel van de Gaer, Flemalle, all of Belgium

[73] Assignee: Colgate, New York, N.Y.

[21] Appl. No.: 725,455

[22] Filed: Apr. 22, 1985

Related U.S. Application Data

[63] Continuation-in-part of Ser. No. 707,342, Mar. 1, 1985.

[51] Int. Cl.[4] ..... C11D 1/66; C11D 3/20
[52] U.S. Cl. ..... 252/99; 252/35; 252/52 A; 252/104; 252/135; 252/139; 252/140; 252/153; 252/154; 252/165; 252/171; 252/172; 252/174.16; 252/174.24; 252/174.25; 252/DIG. 1; 252/DIG. 14
[58] Field of Search ..... 252/18, 21, 35, 52 A, 252/99, 104, 135, 139, 140, 153, 154, 162, 163, 164, 165, 170, 171, 172, 174.16, 174.24, 174.25, 528, 547, DIG. 1, DIG. 14

[56] References Cited

U.S. PATENT DOCUMENTS

| | | | |
|---|---|---|---|
| 2,251,093 | 7/1941 | Williams | 252/21 |
| 3,037,875 | 6/1962 | Geiser | 106/253 |
| 3,282,709 | 11/1966 | Ehrhardt et al. | 106/27 |
| 3,630,929 | 12/1971 | van Dijk | 252/135 |
| 4,226,736 | 10/1980 | Bush et al. | 252/135 |
| 4,264,466 | 4/1981 | Carleton et al. | 252/99 |
| 4,316,812 | 2/1982 | Hancock et al. | 252/99 |

FOREIGN PATENT DOCUMENTS 225142 12/1983 Japan .

*Primary Examiner*—Robert A. Wax
*Attorney, Agent, or Firm*—Herbert S. Sylvester; Murray M. Grill; Blumenkopf

[57] ABSTRACT

A liquid heavy duty laundry detergent composition comprising a suspension of builder salt in liquid nonionic surfactant in which the stability of the composition is improved by the addition of small amounts of an aluminum salt of higher fatty acid, especially aluminum tristearate. The yield stress of the compositions can be improved with the same or lower plastic viscosity, especially at low concentrations of the aluminum salt. The aluminum salts also exhibit an antifoaming effect and can be used to boost softening.

18 Claims, No Drawings

BUILT LIQUID LAUNDRY DETERGENT COMPOSITION CONTAINING SALT OF HIGHER FATTY ACID STABILIZER AND METHOD OF USE

This application is a continuation-in-part of application Ser. No. 707,342, filed Mar. 1, 1985.

BACKGROUND OF THE INVENTION (1) Field of Invention

This invention relates to non-aqueous liquid fabric treating compositions. More particularly, this invention relates to non-aqueous liquid laundry detergent compositions which are stable against phase separation and gelation and are easily pourable and to the use of these compositions for cleaning soiled fabrics.

(2) Discussion of Prior Art

Liquid nonaqueous heavy duty laundry detergent compositions are well known in the art. For instance, compositions of that type may comprise a liquid non-ionic surfactant in which are dispersed particles of a builder, as shown for instance in the U.S. Pat. Nos. 4,316,812; 3,630,929; 4,264,466, and British Pat. Nos. 1,205,711, 1,270,040 and 1,600,981.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are non-dusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have been extensively involved in studying the rheological behavior of nonionic liquid surfactant systems with and without particulate matter suspended therein. Of particular interest has been non-aqueous built laundry liquid detergent compositions and the problems of gelling associated with non-ionic surfactants as well as settling of the suspended builder and other laundry additives. These considerations have an impact on, for example, product pourability, dispersibility and stability.

The rheological behavior of the non-aqueous built liquid laundry detergents can be analogized to the rheological behavior of paints in which the suspended builder particles correspond to the inorganic pigment and the non-ionic liquid surfactant corresponds to the non-aqueous paint vehicle. For simplicity, in the following discussion, the suspended particles, e.g. detergent builder, will sometimes be referred to as the "pigment."

It is known that one of the major problems with paints and built liquid laundry detergents is their physical stability. This problem stems from the fact that the density of the solid pigment particles is higher than the density of the liquid matrix. Therefore, the particles tend to sediment according to Stoke's law. Two basic solutions exist to solve the sedimentation problem: liquid matrix viscosity and reducing solid particle size.

For instance, it is known that such suspensions can be stabilized against settling by adding inorganic or organic thickening agents or dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation.

Grinding to reduce the particle size provides the following advantages:

1. The pigment specific surface area is increased, and, therefore, particle wetting by the non-aqueous vehicle (liquid non-ionic) is proportionately improved.

2. The average distance between pigment particles is reduced with a proportionate increase in particle-to-particle interaction. Each of these effects contributes to increase the rest-gel strength and the suspension yield stress while at the same time, grinding significantly reduces plastic viscosity.

The nonaqueous liquid suspensions of the detergent builders, such as the polyphosphate builders, especially sodium tripolyphosphate (TPP) in nonionic surfactant are found to behave, rheologically, substantially according to the Casson equation:

$$\sigma^{\frac{1}{2}} = \sigma_o^{\frac{1}{2}} + \eta_\infty^{\frac{1}{2}}\gamma$$

where $\gamma$ is the shear rate, $\sigma$ is the shear stress, $\sigma_o$ is the yield stress (or yield value), and $\eta_\infty$ is the "plastic viscosity" (apparent viscosity at infinite shear rate).

The yield stress is the minimum stress necessary to induce a plastic deformation (flow) of the suspension. Thus, visualizing the suspension as a loose network of pigment particles, if the applied stress is lower than the yield stress, the suspension behaves like an elastic gel and no plastic flow will occur. Once the yield stress is overcome, the network breaks at some points and the sample begins to flow, but with a very high apparent viscosity. If the shear stress is much higher than the yield stress, the pigments are partially shear-deflocculated and the apparent viscosity decreases. Finally, if the shear stress is much higher than the yield stress value, the pigment particles are completely shear-deflocculated and the apparent viscosity is very low, as if no particle interaction were present.

Therefore, the higher the yield stress of the suspension, the higher the apparent viscosity at low shear rate and the better is the physical stability of the product.

In addition to the problem of settling or phase separation the non-aqueous liquid laundry detergents based on liquid nonionic surfactants suffer from the drawback that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particulately cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phenomenon can also be a problem whenever it is desired to carry out washing using cold water as may be recommended for certain synthetic and delicate fabrics or fabrics which can shrink in warm or hot water.

Partial solutions to the gelling problem have been proposed by the present inventors and others and include, for example, diluting the liquid nonionic with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc. and nonionic structure modification and optimization. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation.

Nevertheless, still further improvements are desired in both the stability and gel inhibition of non-aqueous liquid fabric treating compositions.

Accordingly, it is an object of the invention to provide liquid fabric treating compositions which are suspensions of insoluble inorganic particles in a non-aqueous liquid and which are storage stable, easily pourable and dispersible in cold, warm or hot water.

Another object of this invention is to formulate highly built heavy duty non-aqueous liquid nonionic surfactant laundry detergent compositions which can be poured at all temperatures and which can be repeatedly dispersed from the dispensing unit of European style automatic laundry washing machines without fouling or plugging of the dispenser even during the winter months.

A specific object of this invention is to provide non-gelling, stable suspensions of heavy duty built non-aqueous liquid nonionic laundry detergent composition which include an amount of aluminum fatty acid salt which is sufficient to increase the yield stress of the composition to thereby increase its stability, i.e. prevent settling of builder particles, etc., preferably while reducing or at least without increasing, the plastic viscosity (viscosity under shear conditions) of the composition.

These and other objects of the invention which will become more apparent from the following detailed description of preferred embodiments are generally provided by adding to the non-aqueous liquid suspension an amount of aluminum fatty acid salt effective to inhibit settling of the suspended inorganic fabric treating particles, e.g. detergent builder, bleaching agent, antistatic agent, pigment, etc.

Accordingly, in one aspect the present invention provides a liquid heavy duty laundry composition composed of a suspension of a detergent builder salt in a liquid nonionic surfactant wherein the composition includes an amount of aluminum fatty acid salt to increase the stability of the suspension and lower its viscosity.

According to another aspect, the invention provides a method for dispensing a liquid nonionic laundry detergent composition into and/or with cold water without undergoing gelation. In particular, a method is provided for filling a container with a non-aqueous liquid laundry detergent composition in which the detergent is composed, at least predominantly, of a liquid nonionic surface active agent and for dispensing the composition from the container into an aqueous wash bath, wherein the dispensing is effected by directing a stream of unheated water onto the composition such that the composition is carried by the stream of water into the wash bath.

The nonionic synthetic organic detergents employed in the practice of the invention may be any of a wide variety of such compounds, which are well known and, for example, are described at length in the text *Surface Active Agents,* Vol. II, by Schwartz, Perry and Berch, published in 1958 by Interscience Publishers, and in McCutcheon's *Detergents and Emulsifiers,* 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 10 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, often being a minor (less than 50%) proportion. Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include Plurafac RA30, Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide, Plurafac B26, and Plurafac RA50 (a mixture of equal parts Plurafac D25 and Plurafac RA40).

Generally, the mixed ethylene oxide-propylene oxide fatty alcohol condensation products can be represented by the general formula $$RO(C_2H_4O)_p(C_3H_6O)_qH,$$

wherein R is a straight or branched, primary or secondary aliphatic hydrocarbon, preferably alkyl or alkenyl, especially preferably alkyl, of from 6 to 20, preferably 10 to 18, especially preferably 14 to 18 carbon atoms, p is a number of from 2 to 12, preferably 4 to 10, and q is a number of from 2 to 7, preferably 3 to 6.

Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will perferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the cases of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity and gel controlling compounds of the invention can also improve the properties of the detergents based on such nonionics. In some cases, as when a higher molecular weight polylower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

As mentioned above, the structure of the liquid nonionic surfactant may be optimized with regard to their carbon chain length and configuration (e.g. linear versus branched chains, etc.) and their content and distribution of alkylene oxide units. Extensive research has shown that these structural characteristics can and do have a profound effect on such properties of the nonionic as pour point, cloud point, viscosity, gelling tendency, as well, of course, as on detergency.

Typically most commercially available nonionics have a relatively large distribution of ethylene oxide (EO) and propylene oxide (PO) units and of the lipophilic hydrocarbon chain length, the reported EO and PO contents and hydrocarbon chain lengths being overall averages. This "polydispersity" of the hydrophilic chains and lipophilic chains can have great importance on the product properties as can the specific values of the average values. The relationship between "polydispersity" and specific chain lengths with product properties for a well-defined nonionic can be shown by the following data for the "Surfactant T" series of nonionics available from British Petroleum. The Surfactant T nonionics are obtained by ethoxylation of secondary $C_{13}$ fatty alcohols having a narrow EO distribution and have the following physical characteristics:

| | EO Content | Pour Paint (°C.) | Cloud Point (1% sol) (°C.) |
|---|---|---|---|
| Surfactant T5 | 5 | <−2 | <25 |
| Surfactant T7 | 7 | −2 | 38 |
| Surfactant T9 | 9 | 6 | 58 |
| Surfactant T12 | 12 | 20 | 88 |

To assess the impact of EO distribution, a "Surfactant T8" was artificially prepared in two ways:

a. 1:1 mixture of T7 and T9 (T8a)

b. 4:3 mixture of T5 and T12 (T8b).

The following properties were found:

| | EO Content (avg) | Pour Point (°C.) | Cloud Point (1% sol'n) (°C.) |
|---|---|---|---|
| Surfactant T8a | 8 | 2 | 48 |
| Surfactant T8b | 8 | 15 | <20 |

From these results, the following general observations can be made:

1. T8a corresponds closely to an actual surfactant T8 as it interpolates well between T7 and T9 for both pour point and cloud point.

2. T8b which is highly polydisperse and would be generally unsatisfactory in view of its high pour point and low cloud point temperatures.

3. The properties of T8a are basically additive between T7 and T9 whereas for T8b the pour point is close to the long EO chain (T12) while the cloud point is close to the short EO chain (T5).

The viscosities of the Surfactant T nonionics were measured at 20%, 30%, 40%, 50%, 60%, 80% and 100% nonionic concentrations for T5, T7, T7/T9 (1:1), T9 and T12 at 25° C. with the following results (when a gel is obtained, the viscosity is the apparent viscosity) at $100^{-sec}$:

| | Viscosity (mPa·s) Nonionic type | | | | |
|---|---|---|---|---|---|
| % | T5 | T7 | T7/T9 | T9 | T12 |
| 100 | 36 | 63 | 61 | 149 | |
| 80 | 65 | | 104 | 112 | 165 |
| 60 | 750 | 78 | 188 | 239 | 32200 |
| 50 | 4000 | 123 | 233 | 634 | 89100 |
| 40 | 2050 | 96 | 149 | 211 | 187 |
| 30 | 630 | 58 | | 38 | 27 |
| 20 | 170 | 78 | | 28 | 100 |

From these results, it may be concluded that Surfactant T7 is less gel-sensitive than T5, and T9 is less gel-sensitive than T12; moreover, the mixture of T7 and T9 (T8) does not gel, and its viscosity does not exceed 225 m Pa·s. T5 and T12 do not form the same gel structure.

Although not wishing to be bound by any particular theory, it is presumed that these results may be accounted for by the following hypothesis:

For T5: with only 5 EO, the hydrodynamic volume of the EO chain is almost the same as the hydrodynamic volume of the fatty chain. Surfactant molecules can accordingly arrange themselves to form a lamellar structure.

For T12: with 12 EO, the hydrodynamic volume of the EO chain is greater than that of the fatty chain. When molecules try to arrange themselves together, an interface curvature occurs and rods are obtained. The superstructure is then hexagonal; with a longer EO chain, or with a higher hydratation, the interface curvature can be such that actual spheres are obtained, and the arrangement of the lowest energy is a face-centered cubic latice.

From T5 to T7 (and T8), the interface curvature increases and the energy of the lamellar structure increases. As the lamellar structure loses stability, its melting temperature is reduced.

From T12 to T9 (and T8), the interface curvature decreases, and the energy of the hexagonal structure increases (rods become bigger and bigger). As the loss in stability occurs, the structure melting temperature is also reduced.

Surfactant T8 appears to be at the critical point at which the lamellar structure is destabilized, i.e. the hexagonal structure is not yet stable enough and no gel is obtained during dilution. In fact, a 50% solution of T8 will finally gel after two days, but the superstructure formation is delayed long enough to allow easy water dispersability.

The effects of the molecular weight on physical properties of the nonionics were also considered. Surfactant T8 (1:1 mixture of T7 and T9) exhibits a good compromise between the lipophilic chain (C13) and the hydrophilic chain (EO8), although the pour point and maximum viscosity on dilution at 25° C. are still high.

The equivalent EO compromise for C10 and C8 lipophilic chains was also determined using the Dobanol 91-x series from Shell Chemical Co., which are ethoxylated derivatives of C9–C11 fatty alcohols (average: C10); and the Alfonic 610-y series from Conoco which are ethoxylated derivatives of $C_6$ to $C_{10}$ fatty alcohols (average $C_8$); x and y represent the EO weight percentage.

The next table reports the physical characteristics of the Alfonic 610-y and Dobanol 91-x series:

| Nonionic | # EO (avg.) | Pour Point (°C.) | Cloud Pt. (°C.) | Max. on dilution at 25° C. (mPa·s) |
|---|---|---|---|---|
| Alfonic 610-50R | 3 | −15 | | Gel (60%) |
| Alfonic 610-60 | 4.4 | −4 | 41 | 36 (60%) |
| Dobanol 91-5 | 5 | −3 | 33 | Gel (70%) |
| Dobanol 91-5T | 6 | +2 | 55 | 126 (50%) |
| Dobanol 91-8 | 8 | +6 | 81 | Gel (50%) |

Dobanol 91-5 and Dobanol 91-8 are commercially available products; Dobanol 91-5 topped (T) is a lab scale product: it is Dobanol 91-5 from which free alcohol has been removed. As the lowest ethoxylation members are also removed, the average EO number is 6. Dobanol 91-5T provides the best results of C10 lipophile chain as it does not gel at 25° C. The 1% cloud point (55° C.) is higher than for surfactant T8 (48° C.). This is presumably due to the lower molecular weight since the mixture entropy is higher. Alfonic 610-60 provides the best results of the C8 lipophile chain series, however, the detergency of this relatively short lipophile chain length compound is too low.

A summary of the best EO contents for each tested lipophilic chain length is provided in the following table:

| Nonionic | # C | # EO | Pour Pt. (°C.) | Cloud Pt. (1% soln) (°C.) | Max h on dil. at 25° C. (mPa·s) |
|---|---|---|---|---|---|
| Surfactant T8 | 13 | 8 | +2 | 48 | 223 (50%) |
| Dobanol 91-5T | 10 | 6 | +2 | 55 | 126 (50%) |
| Alfonic 610-60 | 8 | 4.4 | −4 | 41 | 36 (60%) |

From this data, the following conclusions were reached:

Pour points: as the non-ionic molecular weight decreases its pour points decrease too. The relatively high pour point of Dobanol 91-5T can be accounted for by the higher polydispersity. This was also noticed for T8a and T8b, i.e. the chain polydispersity increases the pour point.

Cloud points: theoretically, as the number of molecules increases (if the molecular weight decreases), the mixing entropy is higher, so the cloud point would increase as the molecular weight decreases. It is actually the case from Surfactant T8 to Dobanol 91-5T but it has not been confirmed with Alfonic 610-60. Here it is presumed that the lipophilic hydrocarbon chain polydispersity is responsible for the theoretically too low cloud point. The relatively large amount of C10-EO present reduces the solubility.

Maximum viscosity on dilution at 25° C.: none of these non-ionics gel at 25° C. when they are diluted with water. The maximum viscosity decreases sharply with the molecular weight. As the non-ionic molecular weight decreases, the less efficient becomes the hydrogen bridges. Unfortunately, too low molecular weight nonionics are not suitable for laundry washing: their micellar critical concentration (MCC) is too high, and a true solution, with only a limited detergency would be obtained under practical laundry conditions.

Accordingly, in the compositions of this invention, one particularly preferred class of nonionic surfactants includes the C12–C13 secondary fatty alcohols with relatively narrow contents of ethylene oxide in the range of from about 7 to 9 moles, especially about 8 moles ethylene oxide per molecule and the C9 to C11, especially C10 fatty alcohols ethoxylated with about 6 moles ethylene oxide.

The invention detergent compositions also include water soluble and/or water insoluble detergent builder salts. Typical suitable builders include, for example, those disclosed in U.S. Pat. Nos. 4,316,812, 4,264,466, and 3,630,929. Water-soluble inorganic alkaline builder salts which can be used alone with the detergent compound or in admixture with other builders are alkali metal carbonate, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred. The alkali metal silicates are useful builder salts which also function to make the composition anticorrosive to washing machine parts. Sodium silicates of $Na_2O/SiO_2$ ratios of from 1.6/1 to 1/3.2, especially about 1/2 to 1/2.8 are preferred. Potassium silicates of the same ratios can also be used.

Another class of builders highly useful herein are the water-insoluble aluminosilicates, both of the crystalline and amorphous type. These builders are particularly compatible with the aluminum tristearate stabilizing agent of this invention. Various crystalline zeolites (i.e. alumino-silicates) are described in British Pat. No. 1,504,168, U.S. Pat. No. 4,409,136 and Canadian Pat. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference. The zeolites generally have the formula $$(M_2O)_x.(Al_2O_3)_y.(SiO_2)_z.WH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq 1 g.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents invariably contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA) and triethanolammonium N-(2-hydroxyethyl)nitrilodiacetates. Mixed salts of these polycarboxylates are also suitable.

Other suitable builders of the organic type include carboxymethylsuccinates, tartronates and glycollates. Of special value are the polyacetal carboxylates. The polyacetal carboxylates and their use in detergent compositions are described in U.S. Pat. Nos. 4,144,226; 4,315,092 and 4,146,495. Other patents on similar builders include U.S. Pat. Nos. 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0015024; 0021491 and 0063399.

According to this invention the physical stability of the suspension of the detergent builder compound or compounds and any other suspended additive, such as bleaching agent, etc., in the liquid vehicle is drastically improved by the presence of the stabilizing agent which is an aluminum salt of a higher fatty acid.

The preferred higher aliphatic fatty acids will have from about 8 to about 22 carbon atoms, more preferably from about 10 to 20 carbon atoms, and especially preferably from about 12 to 18 carbon atoms. The aliphatic radical may be saturated or unsaturated and may be straight or branched. As in the case of the nonionic surfactants, mixtures of fatty acids may also be used, such as those derived from natural sources, such as tallow fatty acid, coco fatty acid, etc.

Examples of the fatty acids from which the aluminum salt stabilizers can be formed include, decanoic acid, dedecanoic acid, palmitic acid, myristic acid, stearic acid, oleic acid, eicosanoic acid, tallow fatty acid, coco fatty acid, mixtures of these acids, etc. The aluminum salts of these acids are generally commercially available, and are preferably used in the triacid form, e.g. aluminum stearate as aluminum tristearate $Al(C_{17}H_{35}COO)_3$. The monoacid salts, e.g. aluminum monostearate, $Al(OH)_2(C_{17}H_{35}COO)$ and diacid salts, e.g. aluminum distearate, $Al(OH)(C_{17}H_{35}COO)_2$, and mixtures of two or three of the mono-, di- and triacid aluminum salts can also be used. It is most preferred, however, that the triacid aluminum salt comprises at least 30%, preferably at least 50%, especially preferably at least 80% of the total amount of aluminum fatty acid salt.

The aluminum salts, as mentioned above, are commercially available and can be easily produced by, for example, saponifying a fatty acid, e.g. animal fat, stearic acid, etc., followed by treatment of the resulting soap with alum, alumina, etc.

Although applicants do not wish to be bound by any particular theory of the manner by which the aluminum salt functions to prevent settling of the suspended particles, it is presumed that the aluminum salt increases the wettability of the solid surfaces by the non-ionic surfactant. This increase in wettability, therefore, allows the suspended particles to more easily remain in suspension.

The increased physical stability is manifested by an increase in the yield stress of the composition by as much as about 500% or more, for example, in the case of aluminum stearate by up to about 1000%, as compared to the same composition without the aluminum stearate stabilizing agent. As described above, the higher is the yield stress, the higher is the apparent viscosity at low shear rate and the better is the physical stability.

Only very small amounts of the aluminum salt stabilizing agent is required to obtain the significant improvements in physical stability. For example, based on the total weight of the composition, suitable amounts of the aluminum salt are in the range of from about 0.1% to about 3%, preferably from about 0.3% to about 1%.

In addition to its action as a physical stabilizing agent, the aluminum salt has the additional advantages over other physical stabilizing agents that it is non-ionic in character and is compatible with the non-ionic surfactant component and does not interfere with the overall detergency of the composition; it exhibits some antifoaming effect; it can function to boost the activity of fabric softeners, and it confers a longer relaxation time to the suspensions.

While the aluminum salt alone is effective in its phyical stabilizing action, further improvements may be achieved in certain cases by incorporation of other known physical stabilizers, such as, for example, an acidic organic phosphorus compound having an acidic—POH group, such as a partial ester of phosphorous acid and an alkanol.

As disclosed in the commonly assigned copending application Ser. No. 597,948, filed Apr. 9, 1984, the disclosure of which is incorporated herein by reference, the acidic organic phosphorous compound having an acidic—POH group can increase the stability of the suspension of builder, especially polyphosphate builders, in the non-aqueous liquid nonionic surfactant.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension significantly more stable against settling on standing but remains pourable, presumably, as a result of increasing the yield value of the suspension, while, for the low concentration of stabilizer, e.g. below about 1%, its plastic viscosity will generally decrease. It is believed that the use of the acidic phosphorus compound may result in the formation of a high energy physical bond between the —POH portion of the molecule and the surfaces of the inorganic polyphosphate builder so that these surfaces take on an organic character and become more compatible with the nonionic surfactant.

The acidic organic phosphorus compound may be selected from a wide variety of materials, in addition to the partial esters of phosphoric acid and alkanols mentioned above. Thus, one may employ a partial ester of phosphoric or phosphorous acid with a mono or polyhydric alcohol such as hexylene glycol, ethylene glycol, di- or tri-ethylene glycol or higher polyethylene glycol, polypropylene glycol, glycerol, sorbitol, mono or diglycerides of fatty acids, etc. in which one, two or more of the alcoholic OH groups of the molecule may be esterified with the phosphorous acid. The alcohol may be a non-ionic surfactant such as an ethoxylated or ethoxylatedpropoxylated higher alkanol, higher alkyl phenol, or higher alkyl amide. The —POH group need not be bonded to the organic portion of the molecule through an ester linkage; instead it may be directly bonded to carbon (as in a phosphonic acid, such as a polystyrene in which some of the aromatic rings carry phosphonic acid or phosphinic acid groups; or an alkylphosphonic acid, such as propyl or laurylphosphonic acid) or may be connected to the carbon through other intervening linkage (such as linkages through O, S or N atoms). Preferably, the carbon:phosphorus atomic ratio in the organic phosphorus compound is at least about 3:1, such as 5:1, 10:1, 20:1, 30:1 or 40:1.

Furthermore, in the compositions of this invention, it may be advantageous to include compounds which function as viscosity control and gel-inhibiting agents for the liquid nonionic surface active agents such as low molecular weight amphiphilic compounds described above which can be considered to be analogous in chemical structure to the ethoxylated and/or propoxylated fatty alcohol nonionic surfactants but which have relatively short hydrocarbon chain lengths (C2–C8) and a low content of ethylene oxide (about 2 to 6 EO units per molecule).

Suitable amphiphilic compounds can be represented by the following general formula $$RO(CH_2CH_2O)_nH$$

where R is a $C_2$–$C_8$ alkyl group, and n is a number of from about 1 to 6, on average.

Specific examples of suitable amphiphilic compounds include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monobutyl ether ($C_8H_{17}$—O—$(CH_2CH_2O)_4H$), etc. Diethylene glycol monobutyl ether is especially preferred.

Further improvements in the rheological properties of the liquid detergent compositions can be obtained by including in the composition a small amount of a nonionic surfactant which has been modified to convert a free hydroxyl group thereof to a moiety having a free carboxyl group, such as a partial ester of a nonionic surfactant and a polycarboxylic acid.

As disclosed in the commonly assigned copending application Ser. No. 597,948, filed Apr. 9, 1984, the disclosure of which is incorporated herein by reference, the free carboxyl group modified nonionic surfactants, which may be broadly characterized as polyether carboxylic acids, function to lower the temperature at which the liquid nonionic forms a gel with water. The acidic polyether compound can also decrease the yield stress of such dispersions, aiding in their dispensibility, without a corresponding decrease in their stability against settling. Suitable polyether carboxylic acids contain a grouping of the formula $$\left(OCH_2CH_2\right)_p\left(\underset{\underset{CH_3}{|}}{OCH}-CH_2\right)_q Y-Z-COOH$$

where $R^2$ is hydrogen or methyl, Y is oxygen or sulfur, Z is an organic linkage, p is a positive number of from about 3 to about 50 and q is zero or a positive number of up to 10. Specific examples include the half-ester of Plurafac RA30 with succinic anhydride, the half ester of Dobanol 25-7 with succinic anhydride, etc. Instead of a succinic acid anhydride, other polycarboxylic acids or anhydrides may be used, e.g. maleic acid, maleic anhydride, glutaric acid, malonic acid, succinic acid, phthalic acid, phthalic anhydride, citric acid, etc. Furthermore, other linkages may be used, such as ether, thioether or urethane linkages, formed by conventional reactions. For instance, to form an ether linkage, the nonionic surfactant may be treated with a strong base (to convert its OH group to an ONa group for instance) and then reacted with a halocarboxylic acid such as chloroacetic acid or chloropropionic acid or the corresponding bromo compound. Thus, the resulting carboxylic acid may have the formula R—Y—ZCOOH where R is the residue of a nonionic surfactant (on removal of a terminal OH), Y is oxygen or sulfur and Z represents an organic linkage such as a hydrocarbon group of, say, one to ten carbon atoms which may be attached to the oxygen (or sulfur) of the formula directly or by means of an intervening linkage such as an oxygen-containing linkage, e.g. a $$-\overset{\overset{O}{\|}}{C}O- \text{ or } -\overset{\overset{O}{\|}}{C}-NH-,$$

etc.

The polyether carboxylic acid may be produced from a polyether which is not a nonionic surfactant, e.g. it may be made by reaction with a polyalkoxy compound such as polyethylene glycol or a monoester or monoether thereof which does not have the long alkyl chain characteristic of the nonionic surfactant. Thus, R may have the formula $$R^1\left(O\overset{\overset{R^2}{|}}{C}H-CH_2\right)_n-$$

where $R^2$ is hydrogen or methyl, $R_1$ is alkylphenyl or alkyl or other chain terminating group and "n" is at least 3 such as 5 to 25. When the alkyl of $R_1$ is a higher alkyl, R is a residue of a nonionic surfactant. As indicated above, $R^1$ may instead be hydrogen or lower alkyl (e.g. methyl, ethyl, propyl, butyl) or lower acyl (e.g. acetyl, etc.). The acidic polyether compound if present in the detergent composition, is preferably added dissolved in the nonionic surfactant.

Since the compositions of this invention are generally highly concentrated, and, therefore, may be used at relatively low dosages, it is desirable to supplement any phosphate builder (such as sodium tripolyphosphate) with an auxiliary builder such as a polymeric carboxylic acid having high calcium binding capacity to inhibit incrustation which could otherwise be caused by formation of an insoluble calcium phosphate. Such auxiliary builders are also well known in the art. For example, mention can be made of Sokolan CP5 which is a copolymer of about equal moles of methacrylic acid and maleic anhydride, completely neutralized to form the sodium salt thereof.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds-suppressors, e.g. silicon compounds can also be used.

The bleaching agents are classified broadly for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with $Cu^{2+}$ ions, such that the stability constant (pK) of the complexation is equal to or greater than 6, at 25° C., in water, of an ionic strength of 0.1 mole/liter, pK being conventionally defined by the formula: $pK = -\log K$ where K represents the equilibrium constant. Thus, for example, the pK values for complexation of copper ion with NTA and EDTA at the stated conditions are 12.7 and 18.8, respectively. Suitable sequestering agents include, for example, in addition to those mentioned above diethylene triamine pentaacetic acid (DETPA); diethylene triamine pentamethylene phosphonic acid (DTPMP); and ethylene diamine tetramethylene phosphonic acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

In a preferred form of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g 1 micron). Preferably less than about 10%, especially less than about 5% of all the suspended particles have particle sizes greater than 10 microns. Compositions whose dispersed particles are of such small size have improved stability against separation or settling on storage. It is found that the acidic polyether compound can decrease the yield stress of such dispersions, aiding in their dispensibility, without a corresponding decrease in their stability against settling.

In the grinding operation, it is preferred that the proportion of solid ingredients be high enough (e.g. at least about 40% such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g., to about 40 microns) prior to the step of grinding to an average particle diameter below about 10 microns in the continuous ball mill.

In the preferred heavy duty liquid detergent compositions of the invention, typical proportions (based on the total composition, unless otherwise specified) of the ingredients are as follows:

Suspended detergent builder, within the range of about 10 to 60% such as about 20 to 50%, e.g. about 25 to 40%;

Liquid phase comprising-nonionic surfactant and optionally dissolved amphiphilic gel-inhibiting compound, within the range of about 30 to 70%, such as about 40 to 60%; this phase may also include minor amounts of a diluent such as a glycol, e.g. polyethylene glycol (e.g. "PEG 400"), hexylene glycol, etc. such as up to 10%, preferably up to 5%, for example, 0.5 to 2%. The weight ratio of nonionic surfactant to amphiphilic compound when the latter is present is in the range of from about 100:1 to 1:1, preferably from about 50:1 to about 2:1.

Aluminum salt of the higher aliphatic fatty acid—at least 0.1%, preferably from about 0.1 to about 3%, more preferably from about 0.3 to about 1%.

Polyether carboxylic acid gel-inhibiting compound, up to an amount to supply in the range of about 0.5 to 10 parts (e.g. about 1 to 6 parts, such as about 2 to 5 parts) of —COOH (M.W. 45) per 100 parts of blend of such acid compound and nonionic surfactant. Typically, the amount of the polyether carboxylic acid compound is in the range of about 0.01 to 1 part per part of nonionic surfactant, such as about 0.05 to 0.6 part, e.g. about 0.2 to 0.5 part;

Acidic organic phosphoric acid compound, as anti-settling agent; up to 5%, for example, in the range of 0.01 to 5%, such as about 0.05 to 2%, e.g. about 0.1 to 1%.

Suitable ranges of the optional detergent additives are: enzymes—0 to 2%, especially 0.7 to 1.3%; corrosion inhibitors—about 0 to 40%, and preferably 5 to 30%; anti-foam agents and suds-suppressors—0 to 15%, preferably 0 to 5%, for example 0.1 to 3%; thickening agent and dispersants—0 to 15%, for example 0.1 to 10%, preferably 1 to 5%; soil suspending or anti-redeposition agents and anti-yellowing agents—0 to 10%, preferably 0.5 to 5%; colorants, perfumes, brighteners and bluing agents total weight 0% to about 2% and preferably 0% to about 1%; pH modifiers and pH buffers—0 to 5%, preferably 0 to 2%; bleaching agent—0% to about 40% and preferably 0% to about 25%, for example 2 to 20%; bleach stabilizers and bleach activators 0 to about 15%, preferably 0 to 10%, for example, 0.1 to 8%; enzyme-inhibitors—0 to 15%, for example, 0.01 to 15%, preferably 0.1 to 10%; sequestering agent of high complexing power, in the range of up to about 5%, preferably ¼ to 3%, such as about ½ to 2%. In the selections of the adjuvants, they will be chosen to be compatible with the main constituents of the detergent composition.

In this application, all proportions and percentages are by weight unless otherwise indicated. In the examples, atmospheric pressure is used unless otherwise indicated.

It is understood that the foregoing detailed description is given merely by way of illustration and that variations may be made therein without departing from the spirit of the invention.

EXAMPLE

A non-aqueous built liquid detergent composition according to the invention is prepared by mixing and finely grinding the following ingredients (ground base A) and thereafter adding to the resulting dispersion, with stirring, the components B:

| | Amount Weight % (Based on A + B) |
|---|---|
| Ground Base A | |
| Plurafac RA50 | 32% |
| Acid Terminated Nonionic (7 EO)[1] | 16% |
| Sodium tripolyphosphate | 30% |
| Sokolan CP5 | 4% |
| Sodium carbonate | 2.5% |
| Sodium perborate monohydrate | 4.5% |
| Tetraacetylethylenediamine | 5% |
| Ethylenediamine tetraacetic acid, disodium salt | 0.5% |
| Tinopal ATS-X (optical brightener) | 0.5% |
| Aluminum stearate | 1% |
| Post Addition B' | |
| Esperase slurry[2] | 1% |
| Plurafac RA50 | 3% |

[1]The esterification product of Dobanol 25-7 with succinic anhydride at a 1:1 molar ratio.
[2]Proteolytic enzyme slurry (in nonionic surfactant)

The yield stress and plastic viscosity of the composition were measured at 25° C. and the values were 19 Pa and 1,150 Pa·sec, respectively. For comparison, the same composition was prepared except that the aluminum stearate was omitted. The yield stress and plastic viscosity values were again measured at 25° C. and were 3Pa and 1,400 Pa·sec, respectively.

It can be seen, therefore, that the presence of even small amounts of aluminum stearate greatly improves product stability while lowering product viscosity.

Similar results will be obtained by replacing the aluminum stearate in the above composition with an equal amount of aluminum myristate, aluminum palmitate, aluminum oleate, aluminum dodecanoate, aluminum tallowate, etc.

What I claim is:

1. A fabric treating composition which comprises a non-aqueous liquid, fabric-treating inorganic particles suspended in said non-aqueous liquid and an aluminum salt or a straight or branched, saturated or unsaturated aliphatic carboxylic acid having from about 8 to about 22 carbon atoms to increase the stability of the suspension, said non-aqueous liquid comprising a nonionic surfactant.

2. The composition of claim 1 wherein the aliphatic carboxylic acid is a straight or branched, saturated or unsaturated carboxylic acid having from about 10 to about 20 carbon atoms.

3. The composition of claim 1 wherein the aliphatic carboxylic acid is a straight or branched, saturated or unsaturated carboxylic acid having from about 12 to about 18 carbon atoms.

4. The composition of claim 1 wherein the aluminum salt is aluminum stearate.

5. The composition of claim 1 wherein the inorganic particles comprise at least one member selected from the following: inorganic detergent builders, bleaching agents, antistatic agents, and pigments.

6. The composition of claim 1 wherein the inorganic particles comprise an alkali metal polyphosphate detergent builder salt.

7. The composition of claim 1 wherein the inorganic particles comprise a crystalline aluminosilicate detergent builder salt.

8. The composition of claim 1 wherein the inorganic particles have a particle size distribution such that no more than about 10% by weight of said particles have a particle size of more than about 10 microns.

9. The composition of claim 1 which further comprises an acid terminated nonionic surfactant as a gel-inhibiting additive in an amount to decrease the temperature at which the surfactant forms a gel in water.

10. The composition of claim 1 which contains from about 0.1 to about 3% by weight, based on the total composition, of said aluminum salt.

11. The composition of claim 6 which further comprises at least one additional suspension stabilizing agent selected from the following: quaternary ammonium compounds, phosphoric esters, modified clays and mixtures thereof.

12. A non-aqueous heavy duty, built laundry detergent composition which is pourable at high and low temperatures and does not gel when mixed with cold water, said composition comprising at least one liquid nonionic surfactant in an amount of from about 20 to about 70% by weight;

at least one detergent builder suspended in the nonionic surfactant in an amount of from about 10 to about 60% by weight;

a compound of the formula $RO(CH_2CH_2O)_nH$ where R is a $C_2$ to $C_8$ alkyl group and n is a number having an average value in the range of from about 1 to 6, as a gel-inhibiting additive in an amount up to about 5% by weight;

an acid organic phosphoric acid compound, as an anti-settling additive, in an amount up to about 5% by weight;

an acid-terminated nonionic surfactant as a gel-inhibiting additive, in an amount up to about 1 part per part of said liquid nonionic surfactant;

aluminum salt of a $C_8$ to $C_{22}$ aliphatic carboxylic acid in an amount of from about 0.1 to about 3% by weight; and optionally, one or more detergent adjuvants selected from the following: enzymes, corrosion inhibitors, anti-foam agents, suds suppressors, soil suspending or anti-redeposition agents, anti-yellowing agents, colorants, perfumes, optical brighteners, bluing agents, pH modifiers, pH buffers, bleaching agents, bleach stabilizers, bleach activators, enzyme inhibitors and sequestering agents.

13. The composition of claim 12 which comprises from about 40 to 60% of liquid nonionic surfactant; from about 20 to 60% by weight of detergent builder suspended in the nonionic surfactant; from about 0.5 to 2% by weight of said compound of the formula $RO(CH_2CH_2O)_nH$; about 0.01 to 5% of said acid organic phosphoric acid compound; and about 0.01 to 1 part, per part of said liquid nonionic surfactant, of said acid-terminated nonionic surfactant; and from about 0.3 to about 1% of said aluminum salt.

14. The composition of claim 13 wherein the aluminum salt is aluminum stearate.

15. A method for cleaning soiled fabrics which comprises contacting the soiled fabrics with the laundry detergent composition of claim 12 in an aqueous wash bath.

16. The method of claim 15 wherein the aluminum salt is aluminum stearate.

17. In a method for filling a container with a non-aqueous liquid laundry detergent composition in which the detergent is composed at least predominantly of a liquid nonionic surface active agent and for dispensing the composition from the container into a water bath in which the laundry is to be washed, wherein the dispensing is effected by directing a stream of unheated tap water onto the composition in the container whereby the composition is carried by the stream of water, into the water bath, the improvement comprising including in the non-aqueous composition from about 0.1 to about 3% by weight of an aluminum salt of a $C_8$ to $C_{22}$ aliphatic carboxylic acid.

18. The method of claim 17 wherein the aluminum salt is aluminum stearate.

* * * * *